US010614761B2

(12) United States Patent
Lee et al.

(10) Patent No.: US 10,614,761 B2
(45) Date of Patent: Apr. 7, 2020

(54) PIXEL, DISPLAY DEVICE, AND METHOD FOR DRIVING THE SAME

(71) Applicant: Samsung Display Co., Ltd., Yongin-si, Gyeonggi-do (KR)

(72) Inventors: Hyo Jin Lee, Yongin-si (KR); Se Hyuk Park, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 21 days.

(21) Appl. No.: 15/870,707

(22) Filed: Jan. 12, 2018

(65) Prior Publication Data

US 2019/0051242 A1 Feb. 14, 2019

(30) Foreign Application Priority Data

Aug. 8, 2017 (KR) ..... 10-2017-0100454

(51) Int. Cl.
*G09G 3/3241* (2016.01)
*G09G 3/3233* (2016.01)

(52) U.S. Cl.
CPC ..... *G09G 3/3241* (2013.01); *G09G 3/3233* (2013.01); *G09G 2300/0426* (2013.01); *G09G 2300/0443* (2013.01); *G09G 2300/0819* (2013.01); *G09G 2300/0842* (2013.01); *G09G 2300/0861* (2013.01); *G09G 2310/0202* (2013.01); *G09G 2310/08* (2013.01); *G09G 2320/045* (2013.01); *G09G 2330/021* (2013.01)

(58) Field of Classification Search
None
See application file for complete search history.

(56) References Cited

U.S. PATENT DOCUMENTS 9,589,504 B2 3/2017 Qing et al.
2016/0019836 A1* 1/2016 Qing ..... G09G 3/3233 345/76

FOREIGN PATENT DOCUMENTS

| | | |
|---|---|---|
| KR | 10-0586714 | 6/2006 |
| KR | 10-0739318 | 7/2007 |
| KR | 10-2012-0041668 | 5/2012 |
| KR | 10-1178468 | 9/2012 |

* cited by examiner

*Primary Examiner* — Kenneth B Lee, Jr.
(74) *Attorney, Agent, or Firm* — Lewis Roca Rothgerber Christie LLP

(57) ABSTRACT

A pixel includes: a first transistor configured generate a driving current corresponding to a data signal transmitted from a corresponding data line; a first light emitting diode (LED) including a cathode connected to a first power supply line and an anode connected to a second power supply line, and configured to emit light by the driving current; a second light emitting diode (LED) including a cathode connected to the second power supply line and an anode connected to the first power supply line, and configured to emit light by the driving current; a second transistor connected to the anode of the first light emitting diode (LED), and configured to transmit the driving current to the first light emitting diode (LED); and a third transistor connected to the anode of the second light emitting diode (LED), and configured to transmit the driving current to the second light emitting diode (LED.

15 Claims, 10 Drawing Sheets

PIXEL, DISPLAY DEVICE, AND METHOD FOR DRIVING THE SAME

CROSS-REFERENCE TO RELATED APPLICATION

This application claims priority to and the benefit of Korean Patent Application No. 10-2017-0100454 filed in the Korean Intellectual Property Office on Aug. 8, 2017, the entire contents of which are incorporated herein by reference.

BACKGROUND

1. Field

Aspects of some example embodiments of the present disclosure relate to a pixel, a display device, and a driving method thereof.

2. Description of the Related Art

A light emitting diode (LED) emits light corresponding to electrical signals applied to respective electrodes, that is, electrodes connected to an anode and a cathode.

In general, the display may be manufactured by spraying very small (e.g., nano-sized) light emitting diodes (LEDs) on the electrodes by use of an injection device such as an inkjet device, and applying voltages to the electrodes to form an electric field, thereby allowing the light emitting diodes (LEDs) to be arranged in a predetermined direction on the electrodes.

The light emitting diodes (LEDs) may be arranged in a predetermined direction between two adjacent electrodes (e.g., a first electrode and a second electrode), and an anode of one light emitting diode (LED) may be connected to the first electrode, while an anode of another light emitting diode (LED) may be connected to the second electrode. Accordingly, when two electrodes are biased with a same voltage, no current flows to some of the light emitting diodes (LEDs) thereby deteriorating emission efficiency.

The above information disclosed in this Background section is only for enhancement of understanding of the background and therefore it may contain information that does not constitute prior art.

SUMMARY

Some example embodiments of the present invention may improve emission efficiency of a light emitting diode (LED).

Some example embodiments of the present invention may initialize parasitic capacitance of a light emitting diode (LED).

According to some example embodiments of the present invention, a pixel includes: a first transistor configured generate a driving current corresponding to a data signal transmitted from a corresponding data line; a first light emitting diode (LED) including a cathode connected to a first power supply line and an anode connected to a second power supply line, and configured to emit light by the driving current; a second light emitting diode (LED) including a cathode connected to the second power supply line and an anode connected to the first power supply line, and configured to emit light by the driving current; a second transistor connected to the anode of the first light emitting diode (LED), and configured to transmit the driving current to the first light emitting diode (LED); and a third transistor connected to the anode of the second light emitting diode (LED), and configured to transmit the driving current to the second light emitting diode (LED), wherein power voltages corresponding to the first power supply line and the second power supply line are applied within a period in which the second transistor and the third transistor are turned off.

According to some example embodiments, a first power voltage applied to the first power supply line corresponds to a second power voltage applied to the second power supply line.

According to some example embodiments, a first end of the second transistor is connected to a first end of the third transistor at a same node, when the second transistor is turned on, the driving current is transmitted to the anode of the first light emitting diode (LED), and when the third transistor is turned on, the driving current is transmitted to the anode of the second light emitting diode (LED).

According to some example embodiments, the pixel further includes a fourth transistor including a first end connected to the data line, a second end connected to a first node, and a gate connected to a corresponding scan line; and a capacitor including a first electrode connected to the first node and a second electrode connected to a third power supply line configured to receive a third power voltage that is different from the first and second power voltages.

According to some example embodiments, the fourth transistor is configured to be turned on for a period in which the second transistor and the third transistor are turned off.

According to some example embodiments, the pixel further includes a fourth transistor including a first end connected to the data line, a second end connected to the first end of the first transistor at a first node, and a gate connected to a corresponding first scan line; a fifth transistor including a first end connected to the second end of the first transistor at a second node, a second end connected to the gate of the first transistor at a third node, and a gate connected to the first scan line; a capacitor including a first electrode connected to the third node, and a second electrode connected to a third power supply line configured to receive a third power voltage that is different from the first and second power voltages; a sixth transistor including a first end connected to the third node, a second end connected to an initialization voltage line configured to receive an initialization voltage, and a gate connected to a corresponding second scan line; and a seventh transistor including a first end connected to the third voltage line, a second end connected to the first node, and a gate connected to a corresponding emission control line.

According to some example embodiments, the fourth transistor, the fifth transistor, and the sixth transistor are configured to be turned on for a period in which the second transistor and the third transistor are turned off, and the seventh transistor is configured to be turned on for a period in which one of the second transistor and the third transistor is turned on.

According to some example embodiments of the present invention, a display device includes: a scan driver configured to transmit a plurality of scan signals to a plurality of scan lines; a data driver configured to transmit a plurality of data signals to a plurality of data lines; a power supply configured to supply a first power voltage, a second power voltage, and a third power voltage to a plurality of first power supply lines, a plurality of second power supply lines, and a third power supply line; a display unit including a plurality of pixels connected to a corresponding first power supply line from among the plurality of first power supply lines, a corresponding second power supply line from among the plurality of second power supply lines, the third power supply line, a corresponding scan line from among the plurality of scan lines, and a corresponding data line from among the plurality of data lines, and configured to enable the plurality of pixels to emit light according to a corresponding data signal and display an image; and a signal controller configured to control the scan driver, the data driver, and the power supply, wherein the plurality of pixels respectively include: a first transistor configured to generate a driving current corresponding to the data signal transmitted from the data line; a first light emitting diode (LED) including a cathode connected to the first power supply line and an anode connected to the second power supply line, and configured to emit light by the driving current; a second light emitting diode (LED) including a cathode connected to the second power supply line and an anode connected to the first power supply line, and configured to emit light by the driving current; a second transistor connected to the anode of the first light emitting diode (LED), and configured to transmit the driving current to the first light emitting diode (LED); and a third transistor connected to the anode of the second light emitting diode (LED), and configured to transmit the driving current to the second light emitting diode (LED), wherein the first power voltage and the second power voltage are applied to the first power supply line and the second power supply line within a period in which the second transistor and the third transistor are turned off.

According to some example embodiments, the first power voltage is equivalent to the second power voltage.

According to some example embodiments, a first end of the second transistor is connected to a first end of the third transistor at a same node, the driving current is transmitted to the anode of the first light emitting diode (LED) when the second transistor is turned on, and the driving current is transmitted to the anode of the second light emitting diode (LED) when the third transistor is turned on.

According to some example embodiments, first light emitting diodes (LEDs) of the plurality of pixels are configured to sequentially emit light for one period, and second light emitting diodes (LED) of the plurality of pixels are configured to sequentially emit light for a next period.

According to some example embodiments, first light emitting diodes (LEDs) of the plurality of pixels are configured to concurrently emit light for one period, and second light emitting diodes (LED) of the plurality of pixels are configured to concurrently emit light for a next period.

According to some example embodiments, the plurality of pixels respectively include: a fourth transistor including a first end connected to the data line, a second end connected to a first node, and a gate connected to the scan line; and a capacitor including a first electrode connected to the first node, and a second electrode connected to the third power supply line.

According to some example embodiments, the fourth transistor is configured to be turned on for a period in which the second transistor and the third transistor are turned off.

According to some example embodiments, the display device further includes a light emission driver configured to transmit a plurality of first emission control signals to a plurality of first emission control lines, a plurality of second emission control signal to a plurality of second emission control lines, and a plurality of third emission control signals to a plurality of third emission control lines, wherein the plurality of scan lines include a plurality of first scan lines and a plurality of second scan lines, and the plurality of pixels respectively further include: a fourth transistor including a first end connected to the data line, a second end connected to a first end of the first transistor at a first node, and a gate connected to a corresponding first scan line from among the plurality of first scan lines; a fifth transistor including a first end connected to a second end of the first transistor at a second node, a second end connected to a gate of the first transistor at a third node, and a gate connected to the first scan line; a capacitor including a first electrode connected to the third node, and a second electrode connected to a third power supply line for receiving a third power voltage that is different from the first and second power voltages; a sixth transistor including a first end connected to the third node, a second end connected to an initialization voltage line for receiving an initialization voltage, and a gate connected to a corresponding second scan line from among the plurality of second scan lines; and a seventh transistor including a first end connected to a third voltage line, a second end connected to the first node, and a gate connected to a corresponding first emission control line from among the plurality of first emission control lines.

According to some example embodiments, the fourth transistor, the fifth transistor, and the sixth transistor are configured to be turned on for a period in which the second transistor and the third transistor are turned off, and the sixth transistor is configured to be turned on for a period in which one of the second transistor and the third transistor is turned on.

According to some example embodiments of the present invention, in a method for driving a display device, the display device including a plurality of pixels including a first transistor for generating a driving current corresponding to a data signal transmitted from a corresponding data line, a first light emitting diode (LED) including a cathode connected to a first power supply line and an anode connected to a second power supply line, and configured to emit light by the driving current, a second light emitting diode (LED) including a cathode connected to the second power supply line and an anode connected to the first power supply line, and configured to emit light by the driving current, a second transistor connected to the anode of the first light emitting diode (LED), and configured to transmit the driving current to the first light emitting diode (LED), a third transistor connected to the anode of the second light emitting diode (LED), and configured to transmit the driving current to the second light emitting diode (LED), and a fourth transistor turned on by a scan signal transmitted from a corresponding scan line and configured to transmit the data signal, the method includes: turning off the second transistor and the third transistor; applying power voltages corresponding to the first power supply line and the second power supply line; applying a corresponding power voltage to one of the first power supply line and the second power supply line; and turning on one corresponding to the power supply line to which the corresponding power voltage is applied from among the second transistor and the third transistor.

According to some example embodiments, the turning off of the second transistor and the third transistor further includes turning on the fourth transistor so as to transmit the data signal.

According to some example embodiments, a first power voltage applied through the first power supply line is equivalent to a second power voltage applied through the second power supply line.

DETAILED DESCRIPTION

Figure 1:
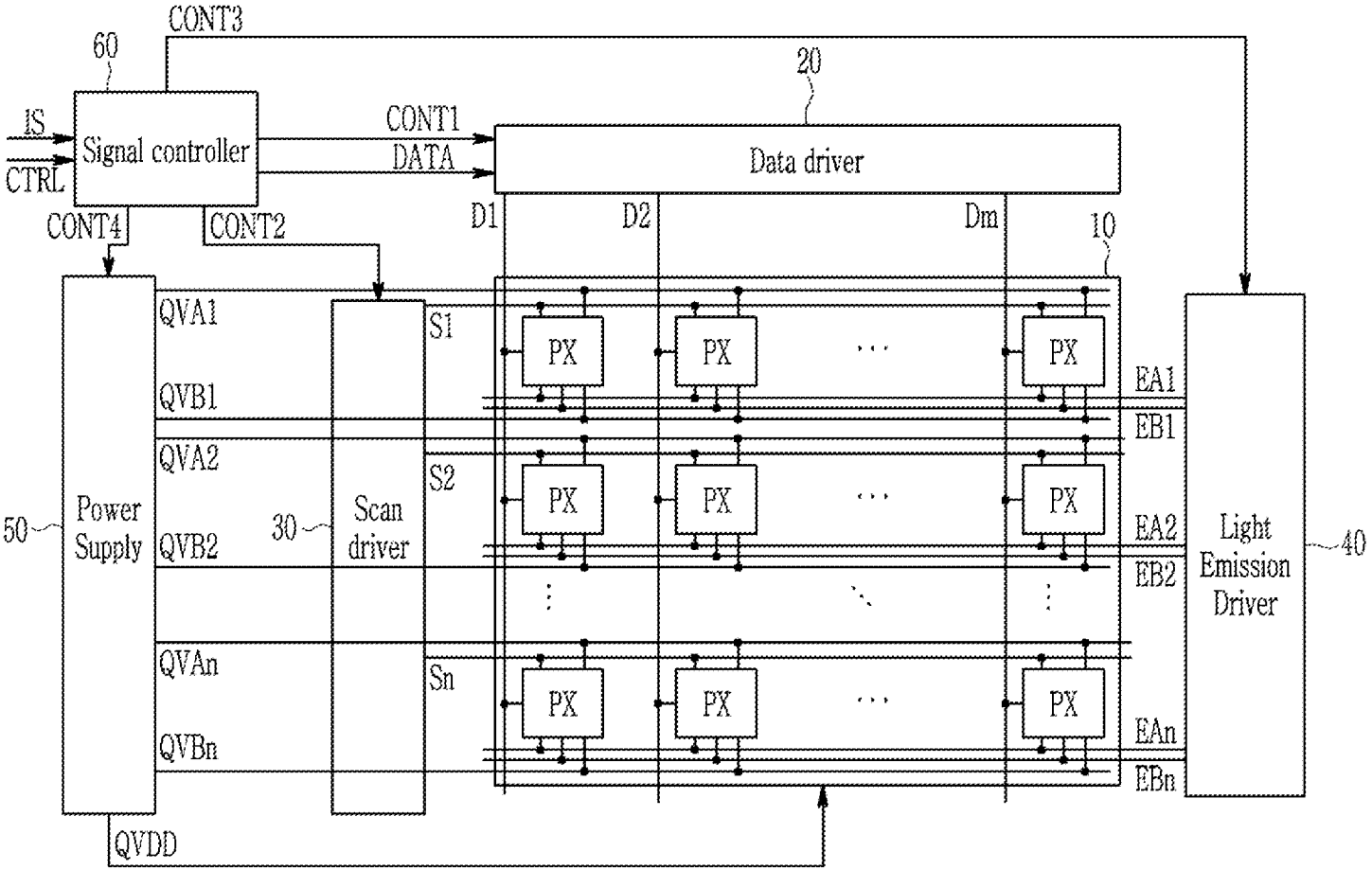
FIG. 1 shows a block diagram of a display device according to an example embodiment.

In the following detailed description, only certain example embodiments of the present invention have been shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive, and like reference numerals designate like elements throughout the specification.

The size and thickness of each configuration shown in the drawings are arbitrarily shown for better understanding and ease of description, and the present invention is not limited thereto. In the drawings, the thickness of layers, films, panels, regions, etc., are exaggerated for clarity. For better understanding and ease of description, the thicknesses of some layers and areas are exaggerated.

It will be understood that when an element such as a layer, film, region, or substrate is referred to as being "on" another element, it can be directly on the other element or intervening elements may also be present. In contrast, when an element is referred to as being "directly on" another element, there are no intervening elements present. The word "on" or "above" means positioned on or below the object portion, and does not necessarily mean positioned on the upper side of the object portion based on a gravitational direction.

Unless explicitly described to the contrary, the word "comprise" and variations such as "comprises" or "comprising" will be understood to imply the inclusion of stated elements but not the exclusion of any other elements.

The phrase "on a plane" means viewing the object portion from the top, and the phrase "on a cross-section" means viewing a cross-section of which the object portion is vertically cut from the side.

FIG. 1 shows a block diagram of a display device according to an example embodiment. Referring to FIG. 1, the display device includes a display unit 10, a data driver 20, a scan driver 30, a light emission driver 40, a power supply 50, and a signal controller 60. Constituent elements shown in FIG. 1 are not essential for realization of the display device, so the display device described in the present specification may have a greater or lesser number of constituent elements than the above-noted constituent elements.

The display unit 10 may be a display panel including a plurality of pixels PXs connected to a corresponding data line from among a plurality of data lines (D1, . . . , Dm), a corresponding scan line from among a plurality of scan lines (S1, . . . , Sn), a corresponding emission control line from among a plurality of emission control lines (EA1, . . . , EAn, EB1, . . . , EBn), and a corresponding power supply line from among a plurality of power supply lines (QVA1, . . . , QVAn, QVB1, . . . , QVBn). The pixels PXs respectively display an image according to a data signal transmitted to the corresponding pixel PX.

The data lines (D1, . . . , Dm) substantially extend in a column direction and are substantially parallel to each other. The scan lines (S1, . . . , Sn) substantially extend in a row direction and are substantially parallel to each other. The emission control lines (EA1, . . . , EAn, EB1, . . . , EBn) substantially extend in a row direction and are substantially parallel to each other. The power supply lines (QVA1, . . . , QVAn, QVB1, . . . , QVBn) substantially extend in a row direction and are substantially parallel to each other.

The data driver 20 is connected to respective pixels PXs of the display unit 10 through the data lines (D1, . . . , Dm). The data driver 20 receives an image data signal (DATA) and transmits a data signal to the corresponding data line from among the data lines (D1, . . . , Dm) according to the control signal CONT1.

The control signal CONT1 is an operation control signal of the data driver 20 generated and transmitted by the signal controller 60. The data driver 20 selects a gray voltage caused by the image data signal (DATA) and transmits the same to a plurality of data lines as a data signal.

The data driver 20 samples and holds the image data signal (DATA) input according to the control signal CONT1, and transmits a plurality of data signals to the data lines (D1, . . . , Dm). For example, the data driver 20 may apply a data signal with a predetermined voltage range to the data lines (D1, . . . , Dm) corresponding to an enable-level scan signal.

The scan driver 30 is connected to the display unit 10 through a plurality of scan lines (S1, . . . , Sn). The scan driver 30 generates a plurality of scan signals according to a control signal CONT2 and transmits the same to the corresponding scan line from among a plurality of scan lines.

The light emission driver 40 generates a plurality of emission control signals according to an emission control signal CONT3. The light emission driver 40 transmits a plurality of emission control signals to a plurality of emission control lines (EA1, . . . , EAn, EB1, . . . , EBn) according to the control signal CONT3.

The power supply 50 supplies a power voltage (VDD) to the display unit 10 through a power supply line (QVDD), and supplies a second power voltage to the pixel PX through a plurality of power supply lines (QVA1, . . . , QVAn, QVB1, . . . , QVBn). The second power voltage supplied to the power supply lines (QVA1, . . . , QVAn) may be different from the second power voltage supplied to the power supply lines (QVB1, . . . , QVBn). The power supply 50 may supply a power voltage for driving the pixel PX according to a control signal CONT4. For example, the power supply 50 may supply the second power voltage to some of the power supply lines, and maintain the remaining power supply lines at a floating state.

The control signals CONT2, CONT3, and CONT4 are operation control signals of the scan driver 30, the light emission driver 40, and the power supply 50 generated and transmitted by the signal controller 60.

The signal controller 60 receives an image signal (IS) input by an external device and an input control signal (CTRL) for controlling displaying thereof. The image signal (IS) may include luminance information distinguished by grays of the respective pixels PXs of the display unit 10.

Examples of the input control signal (CTRL) transmitted to the signal controller 60 include a vertical synchronization signal, a horizontal synchronizing signal, and a main clock signal.

The signal controller 60 generates control signals CONT1 to CONT4 and image data signals (DATA) according to the image signal (IS), the horizontal synchronizing signal, the vertical synchronization signal, and the main clock signal.

The signal controller 60 image-processes the image signal (IS) according to operating conditions of the display unit 10 and the data driver 20 based on the input image signal (IS) and the input control signal (CTRL). In detail, the signal controller 60 may generate an image data signal (DATA) by applying image processing such as gamma correction or luminance compensation to the image signal (IS).

For example, the signal controller 60 generates a control signal CONT1 for controlling the data driver 20, and transmits the same and the image-processed image data signal (DATA) to the data driver 20. The signal controller 60 transmits a control signal CONT2 for controlling the scan driver 30 to the scan driver 30. Further, the signal controller 60 transmits a control signal CONT3 for controlling the light emission driver 40 to the light emission driver 40. In addition, the signal controller 60 transmits a control signal CONT4 for controlling the power supply 50 to the power supply 50.

A pixel PX of the display device will now be described with reference to FIG. 2 to FIG. 4.

Figure 2:
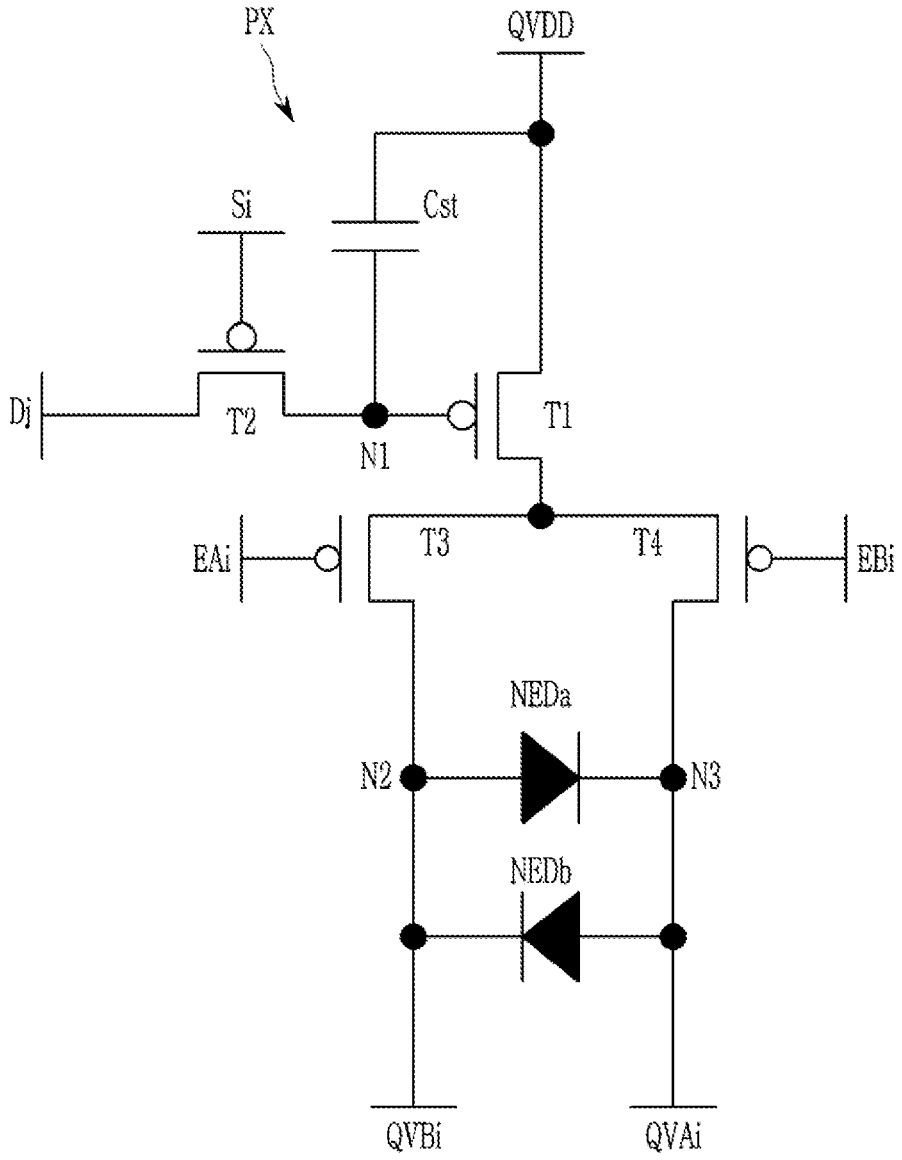
FIG. 2 shows a circuit diagram of a pixel according to an example embodiment.

FIG. 2 shows a circuit diagram of a pixel (PX) according to an example embodiment. Referring to FIG. 2, the pixel PX includes a first transistor T1, a second transistor T2, a storage capacitor Cst, a third transistor T3, a fourth transistor T4, a first light emitting diode (NEDa), and a second light emitting diode (NEDb).

The first transistor T1 includes a gate connected to a first electrode of a storage capacitor Cst at a first node N1, a first end connected to the power supply line (QVDD) for supplying a power voltage (VDD), and a second end electrically connected to an anode of the first light emitting diode (NEDa) via the third transistor T3 and electrically connected to an anode of the second light emitting diode (NEDb) via the fourth transistor T4. The first transistor T1 receives a data signal according to a switching operation of the second transistor T2, and supplies a driving current to the first light emitting diode (NEDa) or the second light emitting diode (NEDb).

The storage capacitor Cst includes a second electrode connected to the power supply line (QVDD).

The second transistor T2 includes a gate connected to a scan line (Si), a first end connected to a data line (Dj), and a second end connected to the gate of the first transistor T1 at the first node N1.

The second transistor T2 performs a switching operation for being turned on by the scan signal received through the scan line (Si) and transmitting the data signal transmitted through the data line (Dj) to the first node N1.

The third transistor T3 includes a gate connected to an emission control line (EAi), a first end connected to the second end of the first transistor T1, and a second end connected to a power supply line (QVBi).

The fourth transistor T4 includes a gate connected to the emission control line (EBi), a first end connected to the second end of the first transistor T1, and a second end connected to the power supply line (QVAi).

When the third transistor T3 is turned on, a driving current from the first transistor T1 is transmitted to the second node N2, that is, the anode of the first light emitting diode (NEDa). When the fourth transistor T4 is turned on, the driving current from the first transistor T1 is transmitted to the third node N3, that is, the anode of the second light emitting diode (NEDb).

A cathode of the first light emitting diode (NEDa) is connected to a power supply line (QVAi), and a cathode of the second light emitting diode (NEDb) is connected to a power supply line (QVBi). The first light emitting diode (NEDa) and the second light emitting diode (NEDb) receive the driving current from the first transistor T1 through the third transistor T3 or the fourth transistor T4 to emit light and thereby displaying the image.

A configuration of the display device will now be described with reference to FIG. 3 and FIG. 4.

Figure 3:
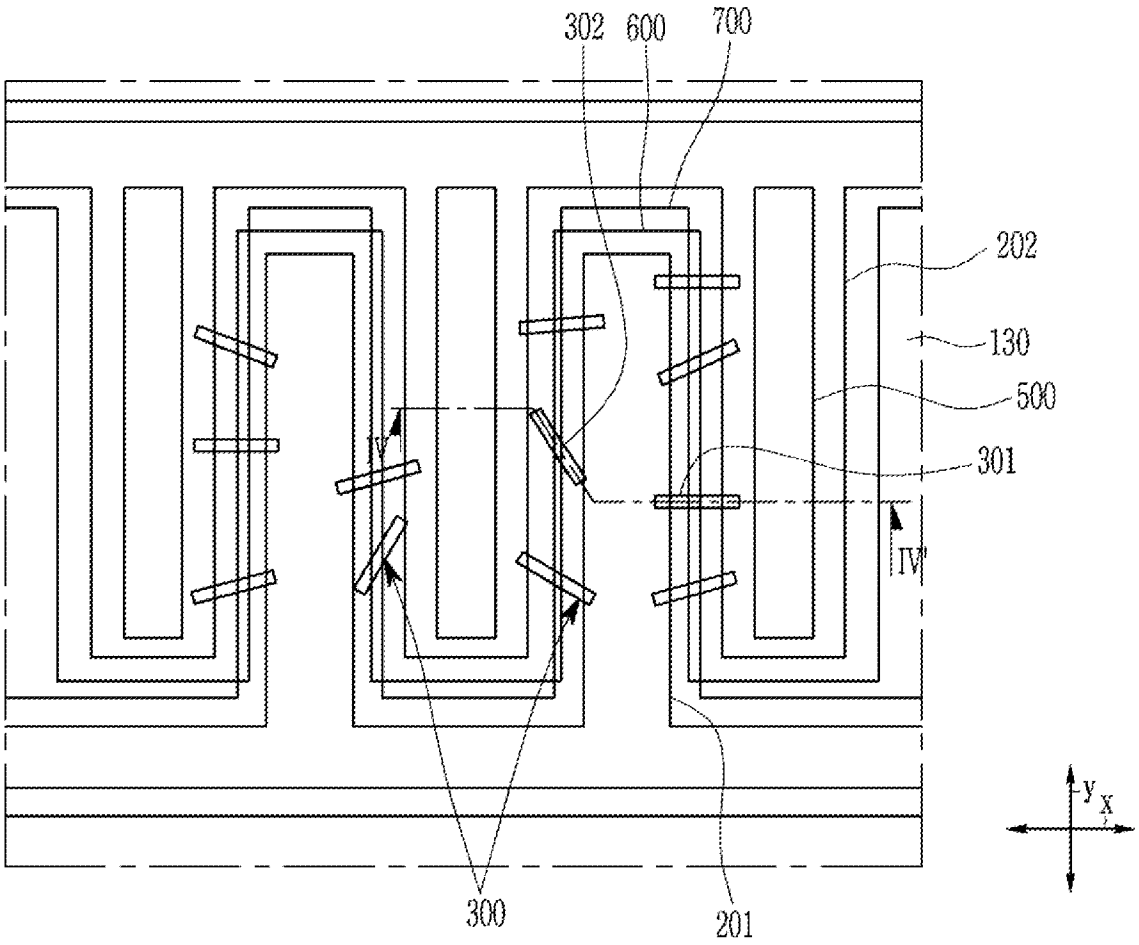
FIG. 3 shows a top plan view of part of a display device according to an example embodiment.
Figure 4:
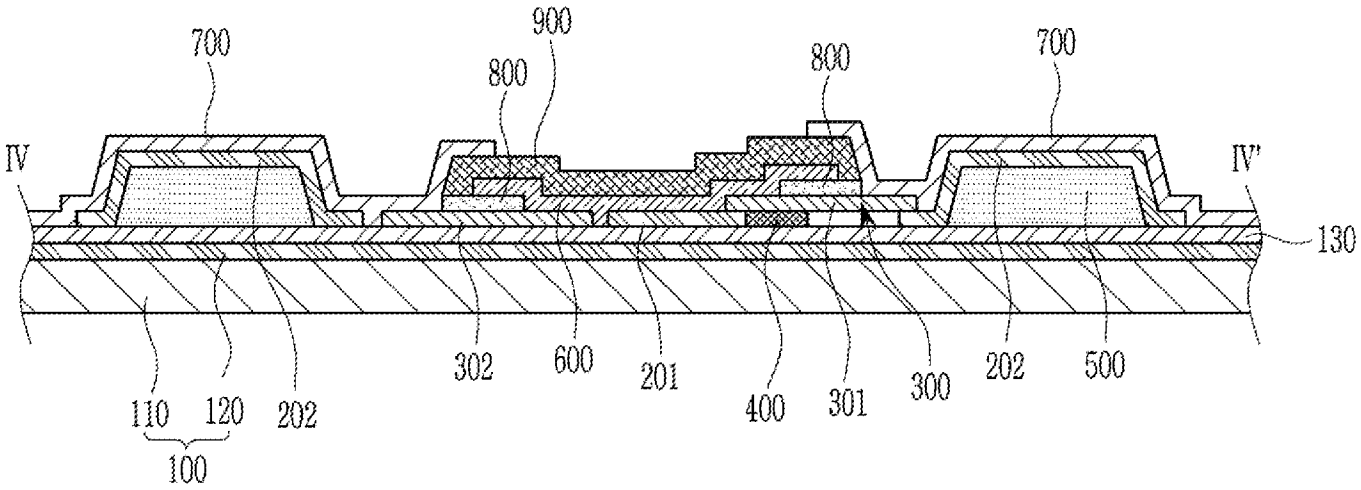
FIG. 4 shows a cross-sectional view with respect to a line IV-IV' of FIG. 3.

FIG. 3 shows a top plan view of part of a display device according to an example embodiment, and FIG. 4 shows a cross-sectional view with respect to a line IV-IV' of FIG. 3.

Referring to FIG. 3 and FIG. 4, the display device represents a device for emitting light by use of a plurality of light emitting diodes (LEDs) of substantially a nanosize.

The display device includes a substrate 100, a driving layer 130, a first electrode 201, a second electrode 202, a plurality of light emitting diodes (LEDs) 300, a connecting pattern 400, a protrusion 500, a first contact portion 600, a second contact portion 700, a first insulating pattern 800, and a second insulating pattern 900.

The substrate 100 may include at least one of glass, an organic material, an inorganic material, and a metal. The substrate 100 may have a flexible, foldable, or bendable characteristic. The substrate 100 includes a substrate main body 110 and a buffer layer 120 provided on the substrate main body 110. The substrate main body 110 may include at least one of the above-noted glass, organic material, inorganic material, and metal. The buffer layer 120 may be provided on an entire surface of the substrate main body 110. The buffer layer 120 may include at least one of glass, an organic material, and an inorganic material.

The driving layer 130 may be provided on the buffer layer 120. In an example embodiment, the driving layer 130 may include a plurality of scan lines, a plurality of emission control lines, a plurality of data lines, a plurality of transistors, and a plurality of capacitors, and these configurations may have various structures known to a person skilled in the art.

The first electrode 201 is provided on the driving layer 130. The first electrode 201 may extend in a first direction (x) to be branched multiple times in a second direction (y) traversing the first direction (x) and extend.

The second electrode 202 is provided on the driving layer 130. The second electrode 202 is separated from the first electrode 201. The second electrode 202 extends in the first direction (x) and is branched multiple times in the second direction (y) and extends.

The first electrode 201 and the second electrode 202 are alternatively arranged in the first direction (x). The first electrode 201 and the second electrode 202 have linear forms, and without being limited thereto, they may have curved line forms. The first electrode 201 and the second electrode 202 are provided on a same plain on the substrate 100, and without being limited thereto, they may be provided on different plains on the substrate 100. The first electrode 201 and the second electrode 202 may be simultaneously (e.g., concurrently) formed by one process, and without being limited thereto, they may be sequentially formed by different processes.

The first electrode 201 and the second electrode 202 may include a corresponding one of the power supply lines (QVA1, . . . , QVAn) or a corresponding one of the power supply lines (QVB1, . . . , QVBn). For example, the first electrode 201 may be a power supply line QVA1, and the second electrode 202 may be a power supply line QVB1.

A plurality of light emitting diodes (LEDs) 300 may be provided between the first electrode 201 and the second electrode 202. The light emitting diodes (LEDs) 300 may be connected to the first electrode 201 and the second electrode 202.

The light emitting diodes (LEDs) 300 may have a substantially nanosize. The light emitting diodes (LEDs) 300 may respectively have various shapes such as a circular cylinder, a triangular prism, a square column, a poly-prism, or a conic shape.

The light emitting diodes (LEDs) 300 may use various kinds of light emitting diodes (LEDs) known to a person skilled in the art may be used for the light emitting diodes (LEDs) included in the display device.

A plurality of light emitting diodes (LEDs) 300 may be applied as a solution to the first electrode 201 and the second electrode 202 by a coating device such as an inkjet device, and they may be arranged between the first electrode 201 and the second electrode 202 by an electric field formed between the first electrode 201 and the second electrode 202. Here, the solution may be in an ink or paste state in which a plurality of light emitting diodes (LEDs) 300 are mixed in a solvent.

The light emitting diodes (LEDs) 300 respectively have an aspect ratio, and they may be arranged in various directions between the first electrode 201 and the second electrode 202. A plurality of light emitting diodes (LEDs) 300 may include a light emitting diode (LED) 301 and a light emitting diode (LED) 302.

The light emitting diode (LED) 301 may be provided on the first electrode 201 and the second electrode 202. The light emitting diode (LED) 301 includes an anode and a cathode contacting the first electrode 201 or the second electrode 202, respectively. For example, the anode of the light emitting diode (LED) 301 may contact the first electrode 201 on the first electrode 201, and the cathode of the light emitting diode (LED) 301 may contact the second electrode 202 on the second electrode 202.

A connecting pattern 400 may be further provided between the light emitting diode (LED) 301 and the driving layer 130. The connecting pattern 400 may be provided between at least one of a plurality of light emitting diodes (LEDs) 300 and the substrate 100. The connecting pattern 400 may overlap at least one of a plurality of light emitting diodes (LEDs) 300. The connecting pattern 400 may electrically connect the light emitting diode (LED) 301 and the driving layer 130.

An anode and a cathode of the light emitting diode (LED) 302 may be provided on the driving layer 130. For example, the anode and the cathode of the light emitting diode (LED) 302 may contact the driving layer 130, and the light emitting diode (LED) 302 may not overlap the first electrode 201 and the second electrode 202.

The protrusion 500 is provided between the substrate 100 and the first electrode 201. The protrusion 500 protrudes upward on a surface of the substrate 100. A first electrode 201 protruding upward by the protrusion 500 is provided on the surface of the protrusion 500. Light emitted by a plurality of light emitting diodes (LEDs) 300 and irradiated in the direction of the protrusion 500 may be reflected upward by the first electrode 201 protruded by the protrusion 500. Accordingly, efficiency of light emitted by a plurality of light emitting diodes (LEDs) 300 is improved.

The first contact portion 600 is provided on the first electrode 201, and it contacts the second electrode 201 and some of a plurality of light emitting diodes (LEDs) 300. The first contact portion 600 may include a transparent conductive material, and it is not limited thereto.

The second contact portion 700 is provided on the second electrode 202, and contacts the second electrode 202 and the other part of a plurality of light emitting diodes (LEDs) 300. The second contact portion 700 may include a transparent conductive material, and it is not limited thereto.

As shown in FIG. 4, part of the first contact portion 600 may overlap part of the second contact portion 700 on the light emitting diode (LED) 302. The light emitting diode (LED) 302 provided between the first electrode 201 and the second electrode 202 may be connected to the first electrode 201 by the first contact portion 600, and the light emitting diode (LED) 302 provided between the first electrode 201 and the second electrode 202 may be connected to the second electrode 202 by the second contact portion 700.

In detail, the light emitting diode (LED) 301 contacts the first electrode 201 and the second electrode 202 and is connected to the first electrode 201 and the second electrode 202, and the light emitting diode (LED) 302 is separated from the first electrode 201 and the second electrode 202 and is not connected to the first electrode 201 and the second electrode 202. However, the first contact portion 600 contacts the first electrode 201 and part of the light emitting diode (LED) 302, and the second contact portion 700 contacts the second electrode 202 and the other part of the light emitting diode (LED) 302, so the light emitting diode (LED) 302 is connected to the first electrode 201 and the second electrode 202.

As described, a plurality of light emitting diodes (LEDs) 300 are connected to the first electrode 201 and the second electrode 202 by the first contact portion 600 and the second contact portion 700, so when some of a plurality of light emitting diodes (LEDs) 300 are separated from the first electrode 201 and the second electrode 202 and are then arranged, a plurality of light emitting diodes (LEDs) 300 are connected to the first electrode 201 and the second electrode 202. Accordingly, when some of the light emitting diodes (LEDs) 300 arranged between the first electrode 201 and the second electrode 202 are separated from the first electrode 201 or the second electrode 202, all light emitting diodes (LEDs) 300 arranged between the first electrode 201 and the second electrode 202 emit light.

One or more insulating patterns 800 and 900 are provided between the first contact portion 600 and the second contact portion 700. The first insulating pattern 800 is provided on a plurality of light emitting diodes (LEDs) 300, between a plurality of light emitting diodes (LEDs) 300 and the first contact portion 600, and between the first contact portion 600 and the second contact portion 700. The second insulating pattern 900 is provided on the first insulating pattern 800, between the first insulating pattern 800 and the second contact portion 700, and between the first contact portion 600 and the second contact portion 700.

A plurality of light emitting diodes (LEDs) 300 may be arranged substantially in one direction between the first electrode 201 and the second electrode 202, and may be electrically connected to the first electrode 201 and the second electrode 202. However, polarities of a plurality of light emitting diodes (LEDs) 300, that is, anodes and cathodes, may be arranged in a random manner.

For example, while a cathode of a certain light emitting diode (LED) 300 may be connected to the first electrode 201 and an anode may be connected to the second electrode 202, a cathode of another light emitting diode (LED) 300 may be connected to the second electrode 202 and an anode may be connected to the first electrode 201. Therefore, when a power voltage is applied to one electrode 201, the light emitting diode (LED) including a cathode connected to the other electrode 202 may not emit light.

According to the pixel PX, the display device, and the driving method thereof in an example embodiment, voltages at the anodes of the light emitting diodes (LEDs) 300 may be initialized and all light emitting diodes (LEDs) 300 may emit light by switching a power voltage applied to the electrodes 201 and 202 as a merit.

A method for driving a display device according to an example embodiment will now be described with reference to FIG. 5 and FIG. 6.

Figure 5:
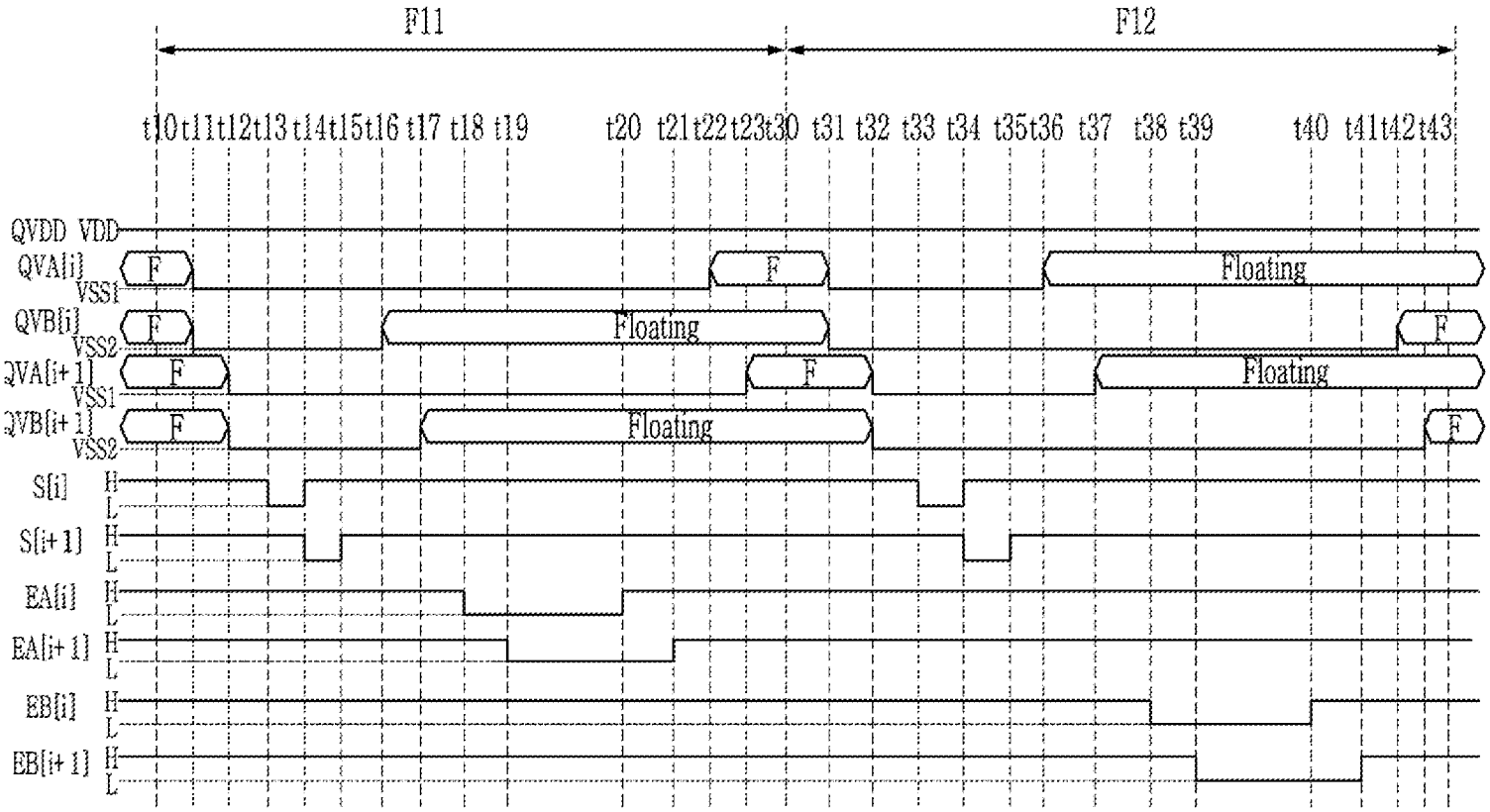
FIG. 5 and FIG. 6 show timing diagrams of a method for driving a display device according to an example embodiment.
Figure 6:
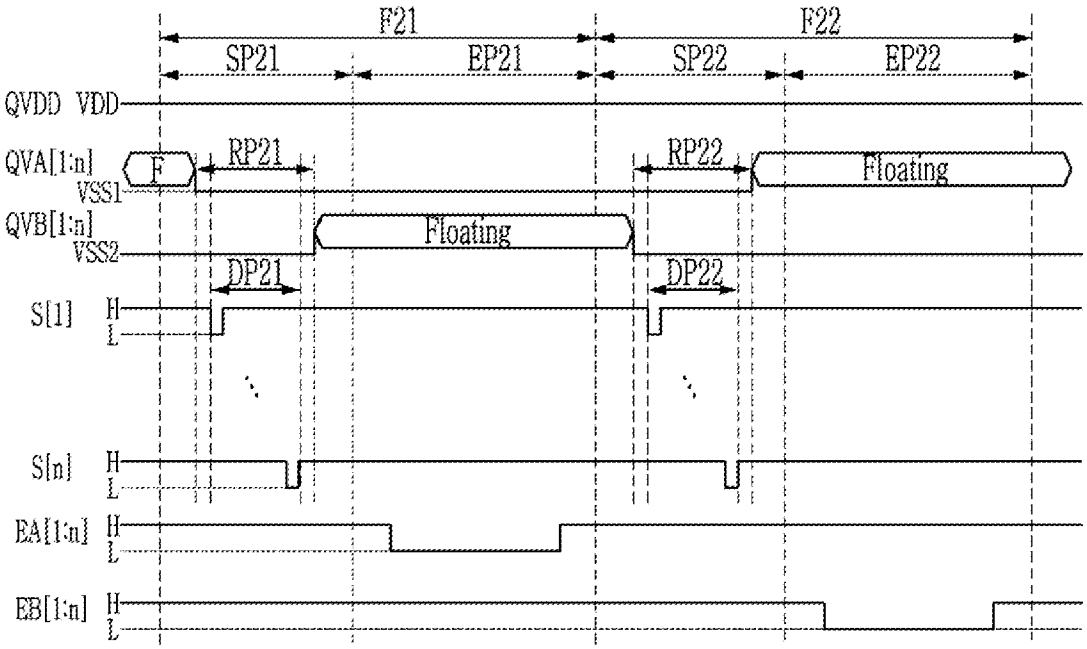

FIG. 5 and FIG. 6 show timing diagrams of a method for driving a display device according to an example embodiment.

An operation of the pixel PX in the i-th row and the pixel PX in the (i+1)-th row connected to the data line (Dj) will now be exemplified with reference to FIG. 5.

For a period of a first frame F11, first light emitting diodes (NEDas) of the pixels PXs of the display unit 10 sequentially emit light. For a period of a second frame F12, second light emitting diodes (NEDbs) of the pixels PXs of the display unit 10 sequentially emit light. For the period of the frames F11 and F12, a power voltage (VDD) of a predetermined level is supplied through a power supply line (QVDD).

At a time t10 in the first frame F11, the power supply lines (QVAi, QVBi, QVAi+1, and QVBi+1) are in the floating state. That is, the power supply 50 does not supply a power voltage to the power supply lines (QVAi, QVBi, QVAi+1, and QVBi+1).

At a time t11, the power voltage (QVA[i]) of a first level VSS1 is supplied to the power supply line (QVAi) by the power supply 50, and the power voltage (QVB[i]) of a second level VSS2 is supplied to the power supply line (QVBi).

At a time t12, the power voltage (QVA[i+1]) of the first level VSS1 is supplied to the power supply line (QVAi+1) by the power supply 50, and the power voltage (QVB[i+1]) of the second level VSS2 is supplied to the power supply line (QVBi+1).

For a period (t11-t16), the power voltage (QVA[i]) of the first level VSS1 may be supplied to the power supply line (QVAi), and the power voltage (QVB[i]) of the second level VSS2 may be supplied to the power supply line (QVBi). For the period (t11-t16), emission control signals (EA[i], EB[i]) of a disable level (H) are applied to the emission lines (EAi and EBi), so third and fourth transistors T3 and T4 of the pixel PX in the i-th row are turned off. The power voltage (QVA[i]) of the first level VSS1 and the power voltage (QVB[i]) of the second level VSS2 are applied to a second node N2 and a third node N3 of the pixel PX in the i-th row, so a voltage level at respective ends of the first and second light emitting diodes NEDa and NEDb of the pixel PX in the i-th row may be reset to have the same level.

For a period (t12-t17), the power voltage (QVA[i+1]) of the first level VSS1 may be supplied to the power supply line (QVAi+1), and the power voltage (QVB[i+1]) of the second level VSS2 may be supplied to the power supply line (QVBi+1). For the period (t12-t17), emission control signals (EA[i+1], EB[i+1]) of the disable level (H) are applied to the emission lines (EAi+1 and EBi+1), so the third and fourth transistors T3 and T4 of the pixel PX in the (i+1)-th row are turned off. The power voltage (QVA[i+1]) of the first level VSS1 and the power voltage (QVB[i+1]) of the second level VSS2 are applied to the second node N2 and the third node N3 of the pixel PX in the (i+1)-th row, so the voltage level at the respective ends of the first and second light emitting diodes NEDa and NEDb of the pixel PX in the (i+1)-th row may be reset to have the same level.

For a period (t13-t14), the scan signal (S[i]) of an enable level (L) is applied to the scan line (Si). A data signal from the data line (Dj) is transmitted to a storage capacitor Cst of the pixel PX in the i-th row.

For a period (t14-t15), the scan signal (S[i+1]) of the enable level (L) is applied to the scan line Si+1. The data signal from the data line (Dj) is transmitted to the storage capacitor Cst of the pixel PX in the (i+1)-th row.

At a time t16, the power supply 50 does not supply a power voltage to the power supply line (QVBi). Therefore, the power supply line (QVBi) is in the floating state.

At a time t17, the power supply 50 does not supply a power voltage to the power supply line (QVBi+1). Hence, the power supply line (QVBi+1) is in the floating state.

For a period (t18-t20), the emission control signal (EA[i]) of the enable level (L) is applied to the emission control line (EAi). A driving current caused by a voltage difference between a voltage at the gate of the first transistor T1 of the pixel PX in the i-th row and the power voltage (VDD) is generated, and the driving current is supplied to the first light emitting diode (NEDa) of the pixel PX in the i-th row through the third transistor T3 turned on by the emission control signal (EA[i]) of the enable level (L).

For a period (t19-t21), the emission control signal (EA[i+1]) of the enable level (L) is applied to the emission control line (EAi+1). A driving current caused by a voltage difference between a voltage at the gate of the first transistor T1 of the pixel PX in the (i+1)-th row and the power voltage (VDD) is generated, and the driving current is supplied to the first light emitting diode (NEDa) of the pixel PX in the (i+1)-th row through the third transistor T3 turned on by the emission control signal (EA[i]) of the enable level (L).

At a time t22, the power supply 50 does not supply a power voltage to the power supply line (QVAi). Therefore, the power supply lines (QVAi, QVBi) are in the floating state.

At a time t23, the power supply 50 does not supply a power voltage to the power supply line (QVAi+1). Hence, the power supply lines (QVAi+1, QVBi+1) are in the floating state.

By the above-described method, the first light emitting diodes (NEDas) of all pixels (PXs) in the display unit 10 may emit light for the period of one frame F11.

At a time t30 in the second frame F12, the power supply lines (QVAi, QVBi, QVAi+1, and QVBi+1) are in the floating state. That is, the power supply 50 does not supply a power voltage to the power supply lines (QVAi, QVBi, QVAi+1, and QVBi+1).

At a time t31, the power voltage (QVA[i]) of the first level VSS1 is supplied to the power supply line (QVAi) by the power supply 50, and the power voltage (QVB[i]) of the second level VSS2 is supplied to the power supply line (QVBi).

At a time t32, the power voltage (QVA[i+1]) of the first level VSS1 is supplied to the power supply line (QVAi+1) by the power supply 50, and the power voltage (QVB[i+1]) of the second level VSS2 is supplied to the power supply line (QVBi+1).

For a period (t31-t36), the power voltage (QVA[i]) of the first level VSS1 may be supplied to the power supply line (QVAi), and the power voltage (QVB[i]) of the second level VSS2 may be supplied to the power supply line (QVBi). For the period (t31-t36), the emission control signals (EA[i], EB[i]) of the disable level (H) are applied to the emission lines (EAi and EBi), so the third and fourth transistors T3 and T4 of the pixel PX in the i-th row are turned off. The power voltage (QVA[i]) of the first level VSS1 and the power voltage (QVB[i]) of the second level VSS2 are then applied to the second node N2 and the third node N3 of the pixel PX in the i-th row, respectively, so the voltage level at the respective ends of the first and second light emitting diodes NEDa and NEDb of the pixel PX in the i-th row may be reset with the same level.

For a period (t12-t17), the power voltage (QVA[i+1]) of the first level VSS1 may be supplied to the power supply line (QVAi+1), and the power voltage (QVB[i+1]) of the second level VSS2 may be supplied to the power supply line (QVBi+1). For the period (t12-t17), the emission control signals (EA[i+1], EB[i+1]) of the disable level (H) are applied to the emission lines (EAi+1 and EBi+1), so the third and fourth transistors T3 and T4 of the pixel PX in the (i+1)-th row are turned off. The power voltage (QVA[i+1]) of the first level VSS1 and the power voltage (QVB[i+1]) of the second level VSS2 are then applied to the second node N2 and the third node N3 of the pixel PX in the (i+1)-th row, so the voltage level at the respective ends of the first and second light emitting diodes NEDa and NEDb of the pixel PX in the (i+1)-th row may be reset with the same level.

For a period (t33-t34), the scan signal (S[i]) of the enable level (L) is applied to the scan line (Si). The data signal from the data line (Dj) is transmitted to the storage capacitor Cst of the pixel PX in the i-th row.

For a period (t34-t35), the scan signal (S[i+1]) of the enable level (L) is applied to the scan line Si+1. The data signal from the data line (Dj) is then transmitted to the storage capacitor Cst of the pixel PX in the (i+1)-th row.

At a time t36, the power supply 50 does not supply a power voltage to the power supply line (QVAi). The power supply line (QVBi) is in the floating state.

At a time t37, the power supply 50 does not supply a power voltage to the power supply line (QVAi+1). Accordingly, the power supply line (QVBi+1) is in the floating state.

For a period (t38-t40), the emission control signal (EB[i]) of the enable level (L) is applied to the emission control line (EBi). A driving current caused by a voltage difference between the voltage at the gate of the first transistor T1 of the pixel PX in the i-th row and the power voltage (VDD) is generated, and the driving current is supplied to the second light emitting diode (NEDb) of the pixel PX in the i-th row through the fourth transistor T4 turned on by the emission control signal (EB[i]) of the enable level (L).

For a period (t39-t41), the emission control signal (EB[i+1]) of the enable level (L) is applied to the emission control line (EBi+1). A driving current caused by a voltage difference between the voltage at the gate of the first transistor T1 of the pixel PX in the (i+1)-th row and the power voltage (VDD) is generated, and the driving current is supplied to the second light emitting diode (NEDb) of the pixel PX in the (i+1)-th row through the fourth transistor T4 turned on by the emission control signal (EB[i]) of the enable level (L).

At a time t42, the power supply 50 does not supply a power voltage to the power supply line (QVBi). Therefore, the power supply lines (QVAi, QVBi) are in the floating state.

At a time t43, the power supply 50 does not supply a power voltage to the power supply line (QVAi+1). Therefore, the power supply lines (QVAi+1, QVBi+1) are in the floating state.

According to the above-described method, the second light emitting diodes (NEDb) of all pixels (PXs) in the display unit 10 may emit light for the period of one frame F12.

According to the driving method of FIG. 5, the first light emitting diodes (NEDas) of the pixel PX in the display unit 10 sequentially emit light for one period, and the second light emitting diodes (NEDbs) of the pixel PX in the display unit 10 sequentially emit light for the next period in a like manner of the first light emitting diodes (NEDas).

A method for simultaneously (e.g., concurrently) driving all pixels (PXs) in the display unit 10 will now be described with reference to FIG. 6. According to an example embodiment of FIG. 6, a plurality of pixels PXs emitting light in the corresponding frame simultaneously (e.g., concurrently) emit light so as to simultaneously (e.g., concurrently) display a one-frame image.

A first frame F21 includes a scan period SP21 and an emission period EP21, and the second frame F22 includes a scan period SP22 and an emission period EP22.

For a reset period RP21 in the scan period SP21, the power voltage (QVA[1:n]) of the first level VSS1 may be supplied to the power supply lines (QVAi . . . QVAn), and the power voltage (QVB[1:n]) of the second level VSS2 may be supplied to the power supply line (QVBi . . . QVBn).

For the reset period RP21, the signals (EA[1:n], EB[1:n]) of the disable level (H) are applied to the emission lines (EA1, . . . , EAn and EB1, . . . , EBn), so the third and fourth transistors T3 and T4 of all pixels (PXs) are turned off. The power voltages (QVA[1:n]) of the first level VSS1 and the power voltages (QVB[1:n]) of the second level VSS2 are applied to the second node N2 and the third node N3 of all pixels (PXs), so the voltage level at the respective ends of the first and second light emitting diodes NEDa and NEDb of all pixels (PXs) is reset with the same level.

For a data programming period DP21, the scan signals (S[1:n]) of the enable level (L) are sequentially applied to the scan lines (S1, . . . , Sn). The data signal from the data lines (D1, . . . , Dm) is sequentially transmitted to the storage capacitor Cst of all pixels (PXs).

Within the emission period EP21, the power supply 50 does not supply a power voltage to the power supply lines (QVB1, . . . , QVBn). Accordingly, the power supply lines (QVB1, . . . , QVBn) are in the floating state.

The emission control signals (EA[1:n]) of the enable level (L) are simultaneously (e.g., concurrently) applied to the emission control lines (EA1, . . . , EAn). A driving current caused by a voltage difference between the voltage at the gate of the first transistor T1 of all pixels (PXs) and the power voltage (VDD) is generated, and the driving current is supplied to the first light emitting diodes (NEDas) of all pixels (PXs) through the third transistor T3 of all pixels (PXs).

The driving method in the scan period SP22 of the second frame F12 corresponds to the driving method in the scan period SP21 of the first frame so it will not be described.

Within the emission period EP22 of the second frame F12, the power supply 50 does not supply a power voltage to the power supply lines (QVA1, . . . , QVAn). Accordingly, the power supply lines (QVA1, . . . , QVAn) are in the floating state.

The emission control signals (EB[1:n]) of the enable level (L) are simultaneously (e.g., concurrently) applied to the emission control lines (EB1, . . . , EBn). A driving current caused by a voltage difference between the voltage at the gate of the first transistor T1 of all pixels (PXs) and the power voltage (VDD) is generated, and the driving current is supplied to the second light emitting diode (NEDb) of all pixels (PXs) through the fourth transistor T4 of all pixels (PXs).

According to the driving method described with reference to FIG. 5 and FIG. 6, for a period except for the emission period, the power voltages VSS1 and VSS2 are supplied to the power supply lines (QVA1, . . . , QVAn, QVB1, . . . , QVBn) to reset anodes and cathodes of the light emitting diodes NEDa and NEDb.

Therefore, it is possible to express more accurate grays by resetting charges stored by parasitic capacitance of the light emitting diodes NEDa and NEDb.

Further, according to the above-noted driving method, the light emitting diodes NEDa and NEDb may be reset during the scan period.

A display device and a driving method thereof according to another example embodiment will now be described with reference to FIG. 7 to FIG. 10.

Figure 7:
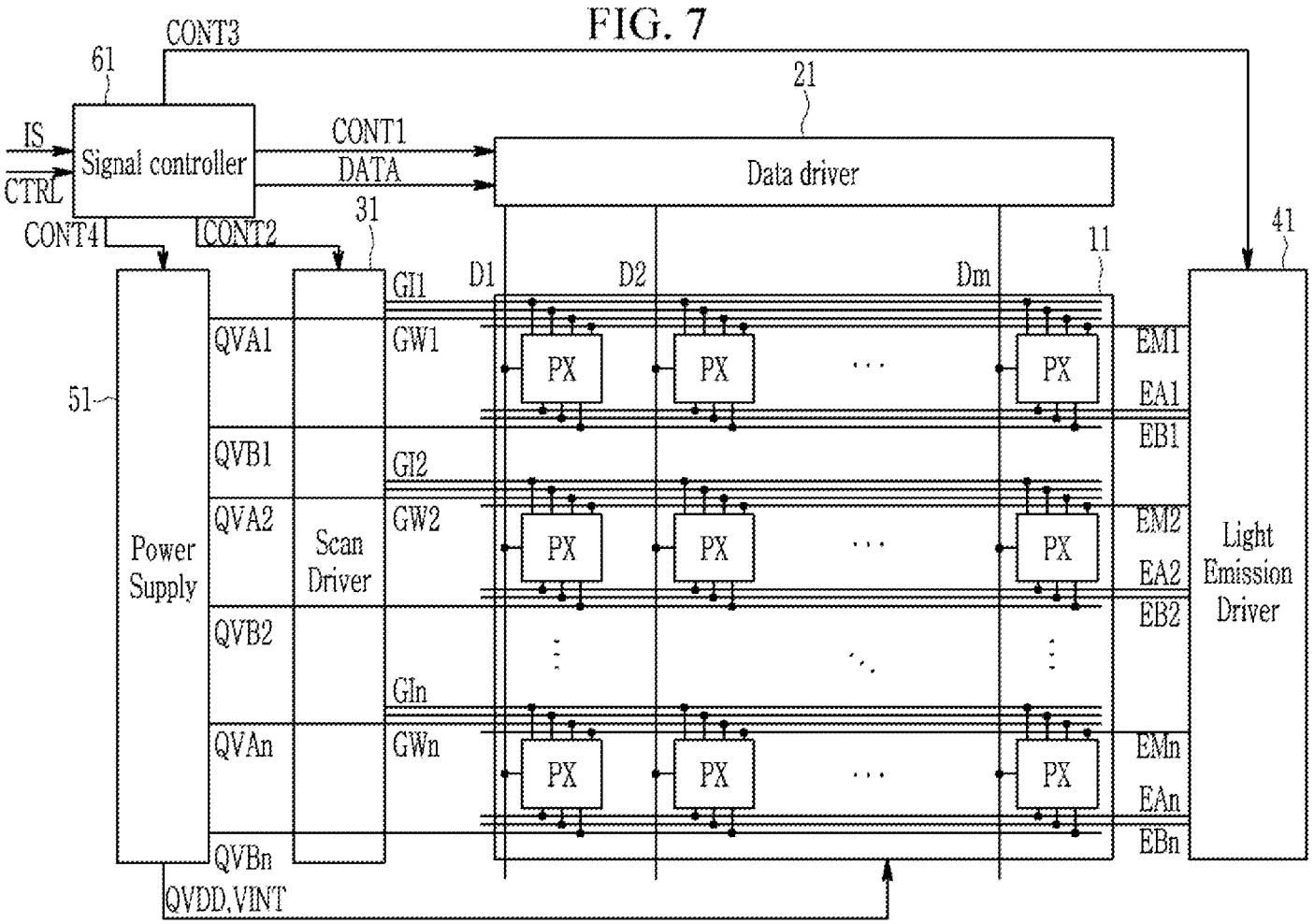
FIG. 7 shows a block diagram of a display device according to another example embodiment.

FIG. 7 shows a block diagram of a display device according to another example embodiment. Referring to FIG. 7, the display device includes a display unit 11, a data driver 21, a scan driver 31, a light emission driver 41, a power supply 51, and a signal controller 61. The display device shown in FIG. 7 has constituent elements that are similar to the constituent elements of the display device shown in FIG. 1, which will not be described.

The display unit 11 may be a display panel including a corresponding data line from among a plurality of data lines (D1, . . . , Dm), a corresponding first scan line from among a plurality of first scan lines (GI1, . . . , GIn), a corresponding second scan line from among a plurality of second scan lines (GW1, . . . , GWn), a corresponding emission control line from among a plurality of emission control lines (EA1, . . . , EAn, EB1, . . . , EBn), and a plurality of pixels PXs connected to a corresponding power supply line from among a plurality of power supply lines (QVA1, . . . , QVAn, QVB1, . . . , QVBn). The pixels PXs respectively display an image according to a data signal transmitted to the corresponding pixel PX.

A plurality of first scan lines (GI1, . . . , GIn) and a plurality of second scan lines (GW1, . . . , GWn) substantially extend in the row direction and are substantially parallel to each other.

The scan driver 31 generates a plurality of scan signals according to a control signal CONT2, and transmits the same to the corresponding first scan line from among a plurality of first scan lines (GI1, . . . , GIn) and the corresponding second scan line from among a plurality of second scan lines (GW1, . . . , GWn).

A pixel PX of the display device will now be described in detail with reference to FIG. 8.

Figure 8:
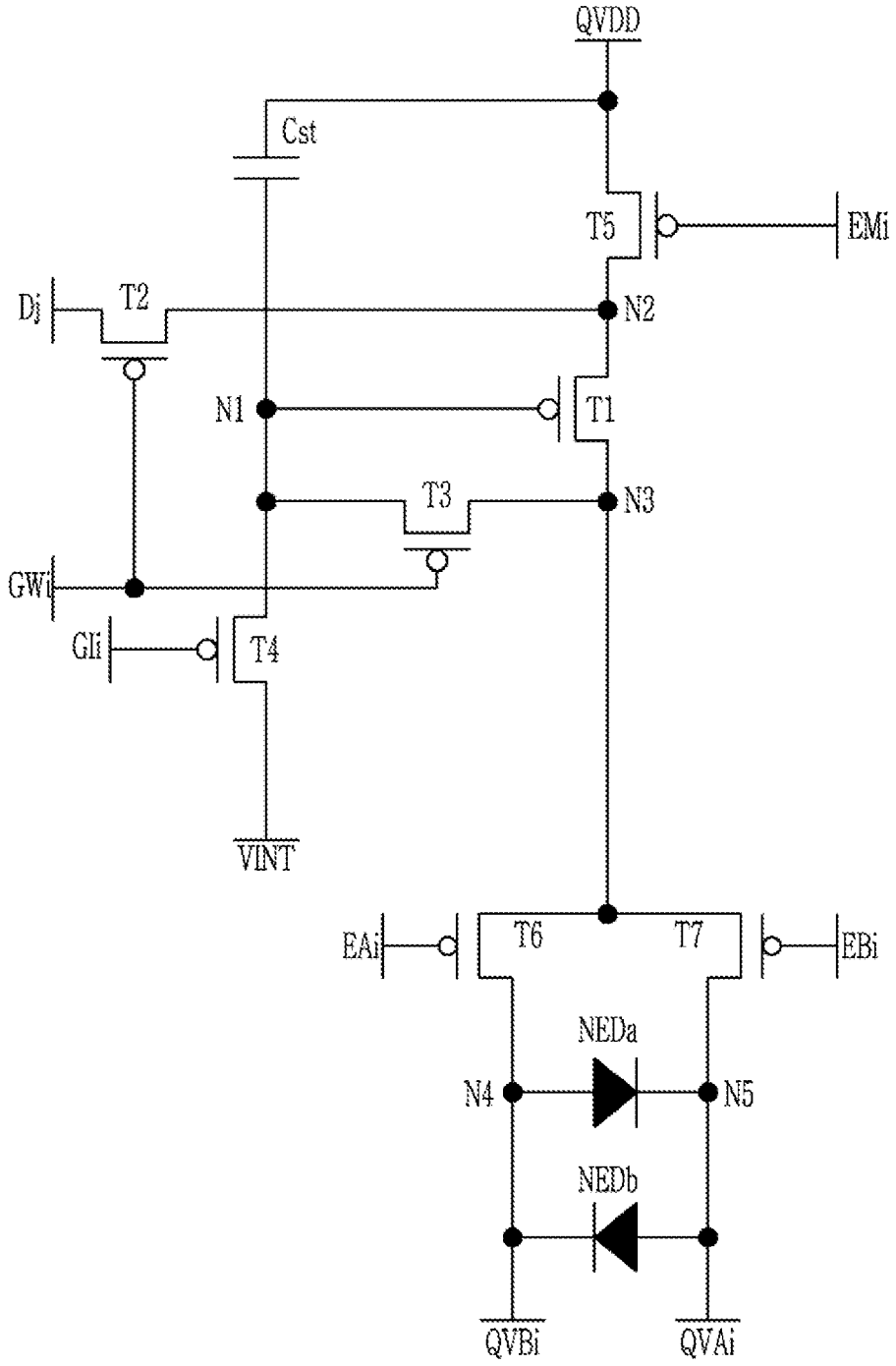
FIG. 8 shows a circuit diagram of a pixel according to another example embodiment.

FIG. 8 shows a circuit diagram of a pixel (PX) according to another example embodiment. Referring to FIG. 8, the pixel PX includes a plurality of transistors T1, T2, T3, T4, T5, T6, and T7 connected to a plurality of signal lines, a storage capacitor Cst, and first and second light emitting diodes NEDa and NEDb.

In detail, the first transistor T1 includes a gate connected to the first node N1, a first end connected to the second node N2, and a second end connected to the third node N3. The first transistor T1 is turned on by the voltage applied to the gate to control the driving current supplied to the first light emitting diode (NEDa) or the second light emitting diode (NEDb).

The second transistor T2 includes a gate connected to the second scan line (GWi), a first end connected to the data line (Dj), and a second end connected to the second node N2. The second transistor T2 is turned on by a second scan signal to transmit a data signal to the second node N2.

The storage capacitor Cst includes a first electrode connected to a power supply line (QVDD) for supplying a power voltage (VDD), and a second electrode connected to the first node N1.

The third transistor T3 includes a gate connected to the second scan line (GWi), a first end connected to the second node N2, and a second end connected to the third node N3. The third transistor T3 is turned on by the second scan signal to connect the first node N1 and the third node N3.

The fourth transistor T4 includes a gate connected to the first scan line (GIi), a first end connected to the second node N2, and a second end connected to an initialization voltage line for supplying an initialization voltage (VINT).

The fifth transistor T5 includes a gate connected to the emission control line (EMi), a first end connected to the power supply line (QVDD), and a second end connected to the second node N2. The fifth transistor T5 is turned on by the emission control signal from the emission control line (EMi).

The sixth transistor T6 includes a gate connected to the emission control line (EAi), a first end connected to the third node N3, and a second end connected to the power supply line (QVBi) at the fourth node N4.

The seventh transistor T7 includes a gate connected to the emission control line (EBi), a first end connected to the third node N3, and a second end connected to the power supply line (QVAi) at the fourth node N4.

When the sixth transistor T6 is turned on, the driving current is transmitted to the anode of the first light emitting diode (NEDa). When the seventh transistor T7 is turned on, the driving current is transmitted to the anode of the second light emitting diode (NEDb).

The first light emitting diode (NEDa) includes a cathode connected to the power supply line (QVAi), and the second light emitting diode (NEDb) includes a cathode connected to the power supply line (QVBi). The first light emitting diode (NEDa) and the second light emitting diode (NEDb) respectively receive a driving current through the sixth transistor T6 or the seventh transistor T7 to emit light and thereby display an image.

A method for driving a display device according to another example embodiment will now be described with reference to FIG. 9 and FIG. 10.

Figure 9:
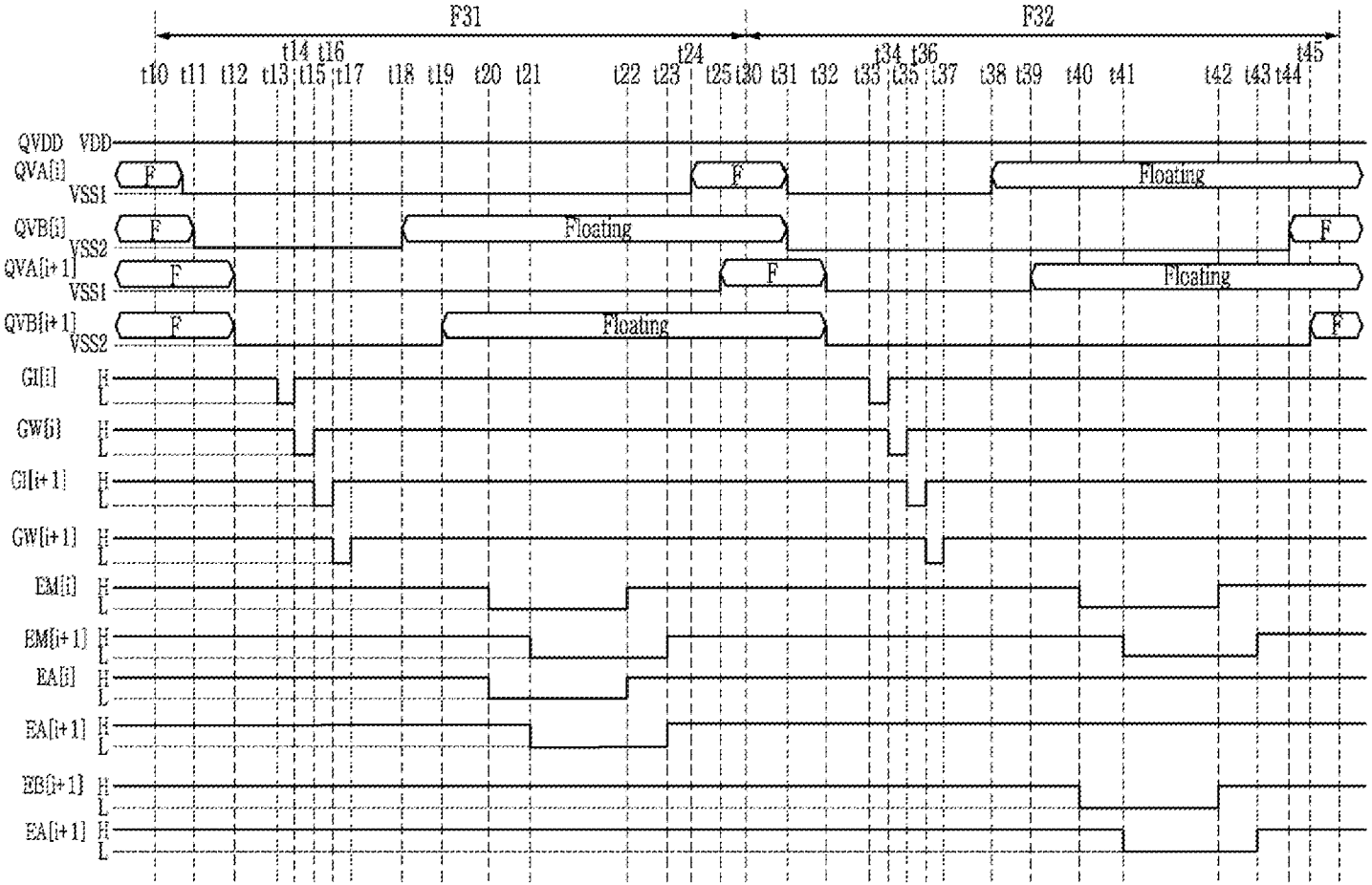
FIG. 9 and FIG. 10 show timing diagrams of a method for driving a display device according to another example embodiment.
Figure 10:
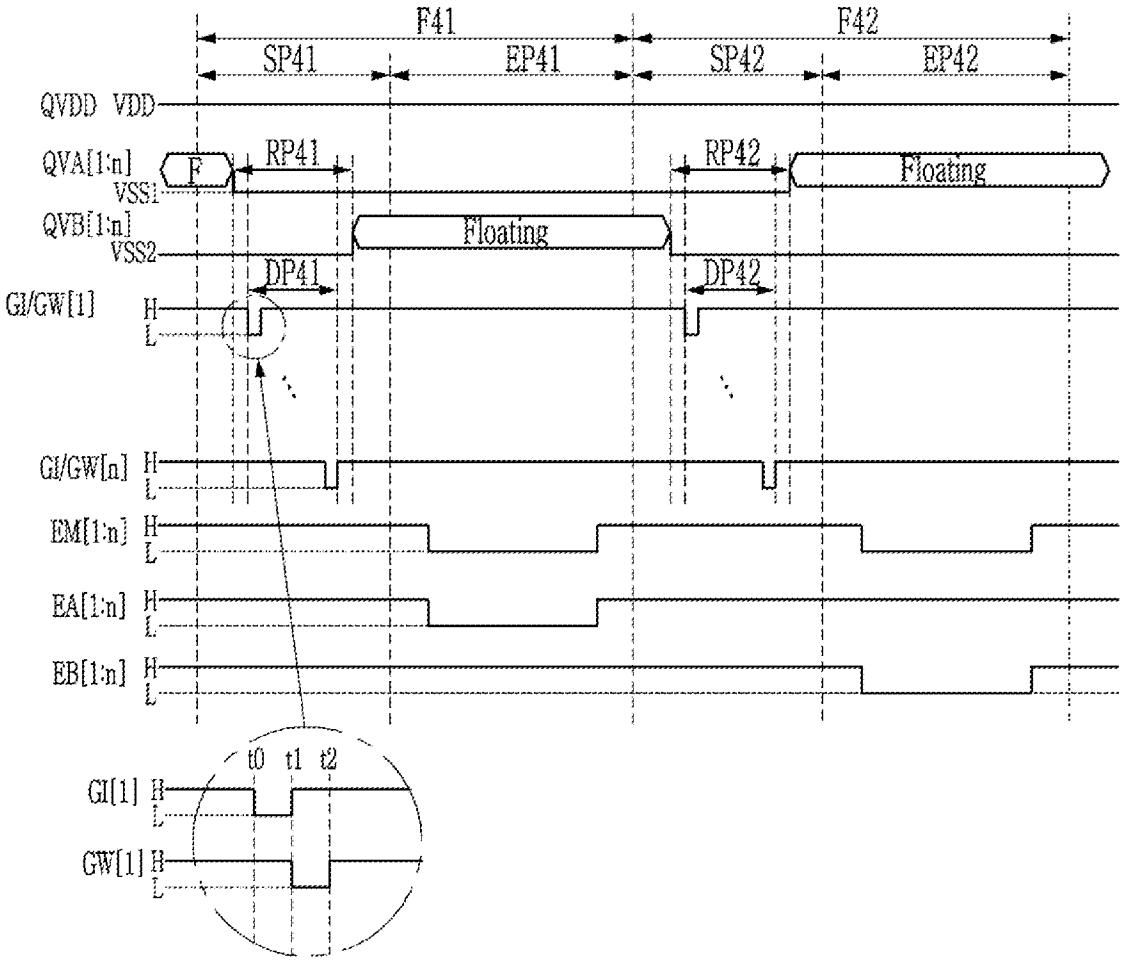

FIG. 9 and FIG. 10 show timing diagrams of a method for driving a display device according to another example embodiment.

An operation of the pixel PX in the i-th row and the pixel PX in the (i+1)-th row connected to the data line (Dj) will now be described with reference to FIG. 9.

For a first frame F31, the first light emitting diodes (NEDas) of the pixels PXs of the display unit 11 sequentially emit light. For a second frame F32, the second light emitting diodes (NEDbs) of the pixels PXs of the display unit 10 sequentially emit light. For the period of two frames F31 and F32, the power voltage (VDD) of a predetermined level is supplied through the power supply line (QVDD).

At a time t10 in the first frame F31, the power supply lines (QVAi, QVBi, QVAi+1, and QVBi+1) are in the floating state. That is, the power supply 50 does not supply a power voltage to the power supply lines (QVAi, QVBi, QVAi+1, and QVBi+1).

At a time t11, the power voltage (QVA[i]) of the first level VSS1 is supplied to the power supply line (QVAi) by the power supply 50, and the power voltage (QVB[i]) of the second level VSS2 is supplied to the power supply line (QVBi).

At a time t12, the power voltage (QVA[i+1]) of the first level VSS1 is supplied to the power supply line (QVAi+1) by the power supply 50, and the power voltage (QVB[i+1]) of the second level VSS2 is supplied to the power supply line (QVBi+1).

For a period (t11-t18), the power voltage (QVA[i]) of the first level VSS1 may be supplied to the power supply line (QVAi), and the power voltage (QVB[i]) of the second level VSS2 may be supplied to the power supply line (QVBi). For the period (t11-t18), the emission control signals (EA[i], EB[i]) of the disable level (H) are applied to the emission lines (EAi and EBi), so the third and fourth transistors T3 and T4 of the pixel PX in the i-th row are turned off. The power voltage (QVA[i]) of the first level VSS1 and the power voltage (QVB[i]) of the second level VSS2 are applied to the second node N2 and the third node N3 of the pixel PX in the i-th row, so the voltage level at the respective ends of the first and second light emitting diodes NEDa and NEDb of the pixel PX in the i-th row may be reset with the same level.

For a period (t12-t19), the power voltage (QVA[i+1]) of the first level VSS1 may be supplied to the power supply line (QVAi+1), and the power voltage (QVB[i+1]) of the second level VSS2 may be supplied to the power supply line (QVBi+1). For the period (t12-t19), the emission control signals (EA[i+1], EB[i+1]) of the disable level (H) are applied to the emission lines (EAi+1 and EBi+1), so the third and fourth transistors T3 and T4 of the pixel PX in the (i+1)-th row are turned off. The power voltage (QVA[i+1]) of the first level VSS1 and the power voltage (QVB[i+1]) of the second level VSS2 are applied to the second node N2 and the third node N3 of the pixel PX in the (i+1)-th row, so the voltage level at the respective ends of the first and second light emitting diodes NEDa and NEDb of the pixel PX in the (i+1)-th row may be reset with the same level.

For a period (t13-t14), the first scan signal (GI[i]) of the enable level (L) is applied to the first scan line (GIi). The initialization voltage (VINT) is then transmitted to the first node N1 through the fourth transistor T4 of the turned on pixel PX in the i-th row to initialize the gate of the first transistor T1.

For a period (t14-t15), the second scan signal (GW[i]) of the enable level (L) is applied to the second scan line (GWi). The data signal from the data line (Dj) is transmitted to the storage capacitor Cst of the pixel PX in the i-th row.

For a period (t15-t16), the first scan signal (GI[i+1]) of the enable level (L) is applied to the first scan line (GIi+1). The initialization voltage (VINT) is transmitted to the first node N1 through the fourth transistor T4 of the turned on pixel PX in the (i+1)-th row to initialize the gate of the first transistor T1.

For a period (t16-t17), the second scan signal (GW[i+1]) of the enable level (L) is applied to the second scan line (GWi+1). The data signal from the data line (Dj) is transmitted to the storage capacitor Cst of the pixel PX in the (i+1)-th row.

At a time t18, the power supply 51 does not supply a power voltage to the power supply line (QVBi). Accordingly, the power supply line (QVBi) is in the floating state.

At a time t19, the power supply 51 does not supply a power voltage to the power supply line (QVBi+1). Accordingly, the power supply line (QVBi+1) is in the floating state.

For a period (t20-t22), the emission control signal (EM[i]) of the enable level (L) is applied to the emission control line (EMi), and the emission control signal (EA[i]) of the enable level (L) is applied to the emission control line (EAi). A driving current caused by a voltage difference between the voltage at the gate of the first transistor T1 of the pixel PX in the i-th row and the power voltage (VDD) is generated, and the driving current is supplied to the first light emitting diode (NEDa) of the pixel PX in the i-th row through the sixth transistor T6.

Fora period (t21-t23), the emission control signal (EM[i+1]) of the enable level (L) is applied to the emission control line (Emi+1), and the emission control signal (EA[i+1]) of the enable level (L) is applied to the emission control line (EAi+1). A driving current caused by a voltage difference between the voltage at the gate of the first transistor T1 of the pixel PX in the i-th row and the power voltage (VDD) is generated, and the driving current is supplied to the first light emitting diode (NEDa) of the pixel PX in the i-th row through the sixth transistor T6.

At a time t24, the power supply 51 does not supply a power voltage to the power supply line (QVAi). Therefore, the power supply lines (QVAi, QVBi) are in the floating state.

At a time t25, the power supply 51 does not supply a power voltage to the power supply line (QVAi+1). Accordingly, the power supply lines (QVAi+1, QVBi+1) are in the floating state.

By the above-described method, for the period of one frame F31, the first light emitting diodes (NEDas) of all pixels (PXs) in the display unit 11 may emit light.

At a time t30 in the second frame F32, the power supply lines (QVAi, QVBi, QVAi+1, and QVBi+1) are in the floating state. That is, the power supply 50 does not supply a power voltage to the power supply lines (QVAi, QVBi, QVAi+1, and QVBi+1).

At a time t31, the power voltage (QVA[i]) of the first level VSS1 is supplied to the power supply line (QVAi) by the power supply 50, and the power voltage (QVB[i]) of the second level VSS2 is supplied to the power supply line (QVBi).

At a time t32, the power voltage (QVA[i+1]) of the first level VSS1 is supplied to the power supply line (QVAi+1) by the power supply 50, and the power voltage (QVB[i+1]) of the second level VSS2 is supplied to the power supply line (QVBi+1).

For a period (t31-t38), the power voltage (QVA[i]) of the first level VSS1 may be supplied to the power supply line (QVAi), and the power voltage (QVB[i]) of the second level VSS2 may be supplied to the power supply line (QVBi). For the period (t31-t38), the emission control signals (EA[i], EB[i]) of the disable level (H) are applied to the emission lines (EAi and EBi), so the third and fourth transistors T3 and T4 of the pixel PX in the i-th row are turned off. The power voltage (QVA[i]) of the first level VSS1 and the power voltage (QVB[i]) of the second level VSS2 are applied to the second node N2 and the third node N3 of the pixel PX in the i-th row, respectively, so the voltage level at the respective ends of the first and second light emitting diodes NEDa and NEDb of the pixel PX in the i-th row may be reset with the same level.

For a period (t32-t39), the power voltage (QVA[i+1]) of the first level VSS1 may be supplied to the power supply line (QVAi+1), and the power voltage (QVB[i+1]) of the second level VSS2 may be supplied to the power supply line (QVBi+1). For the period (t32-t39), the emission control signals (EA[i+1], EB[i+1]) of the disable level (H) may be supplied to the emission lines (EAi+1 and EBi+1), and the third and fourth transistors T3 and T4 of the pixel PX in the (i+1)-th row are turned off. The power voltage (QVA[i+1]) of the first level VSS1 and the power voltage (QVB[i+1]) of the second level VSS2 are applied to the second node N2 and the third node N3 of the pixel PX in the (i+1)-th row, so the voltage level at the respective ends of the first and second light emitting diodes NEDa and NEDb of the pixel PX in the (i+1)-th row may be reset with the same level.

For a period (t33-t34), the first scan signal (GI[i]) of the enable level (L) is applied to the first scan line (GIi). The initialization voltage (VINT) is transmitted to the first node N1 through the fourth transistor T4 of the turned on pixel PX in the i-th row to initialize the gate of the first transistor T1.

For a period (t34-t35), the second scan signal (GW[i]) of the enable level (L) is applied to the second scan line (GWi). The data signal from the data line (Dj) is transmitted to the storage capacitor Cst of the pixel PX in the i-th row.

For a period (t35-t36), the first scan signal (GI[i+1]) of the enable level (L) is applied to the first scan line (GIi+1). The initialization voltage (VINT) is transmitted to the first node N1 through the fourth transistor T4 of the turned on pixel PX in the (i+1)-th row to initialize the gate of the first transistor T1.

For a period (t36-t37), the second scan signal (GW[i+1]) of the enable level (L) is applied to the second scan line (GWi+1). The data signal from the data line (Dj) is transmitted to the storage capacitor Cst of the pixel PX in the (i+1)-th row.

At a time t38, the power supply 51 does not supply a power voltage to the power supply line (QVAi). Therefore, the power supply line (QVAi) is in the floating state.

At a time t39, the power supply 51 does not supply a power voltage to the power supply line (QVAi+1). Therefore, the power supply line (QVAi+1) is in the floating state.

For a period (t40-t42), the emission control signal (EM[i]) of the enable level (L) is applied to the emission control line (EMi), and the emission control signal (EB[i]) of the enable level (L) is applied to the emission control line (EBi). A driving current caused by the voltage difference between the voltage at the gate of the first transistor T1 of the pixel PX in the i-th row and the power voltage (VDD), and the driving current is supplied to the second light emitting diode (NEDb) of the pixel PX in the i-th row through the sixth transistor T6.

Fora period (t41-t43), the emission control signal (EM[i+1]) of the enable level (L) is applied to the emission control line (EMi+1), and the emission control signal (EB[i+1]) of the enable level (L) is applied to the emission control line (EBi+1). A driving current caused by the voltage difference between the voltage at the gate of the first transistor T1 of the pixel PX in the i-th row and the power voltage (VDD) is generated, and the driving current is supplied to the second light emitting diode (NEDb) of the pixel PX in the i-th row through the sixth transistor T6.

At a time t44, the power supply 51 does not supply a power voltage to the power supply line (QVBi). Therefore, the power supply lines (QVAi, QVBi) are in the floating state.

At a time t45, the power supply 51 does not supply a power voltage to the power supply line (QVBi+1). Therefore, the power supply lines (QVAi+1, QVBi+1) are in the floating state.

By the above-described method, for the period of one frame F32, the second light emitting diodes (NEDbs) of all pixels (PXs) in the display unit 11 may emit light.

According to the driving method of FIG. 9, the first light emitting diodes (NEDas) of the pixel PX in the display unit 11 sequentially emit light for one period, and the second light emitting diodes (NEDbs) of the pixel PX in the display unit 11 sequentially emit light for the next period in a like manner of the first light emitting diodes (NEDas).

A driving method for all pixels (PXs) in the display unit 11 to simultaneously (e.g., concurrently) emit light will now be described with reference to FIG. 10.

According to an example embodiment of FIG. 10, a plurality of pixels PXs emitting light for the corresponding frame simultaneously (e.g., concurrently) emit light so as to simultaneously (e.g., concurrently) display an image of one frame.

The first frame F41 includes a scan period SP41 and an emission period EP41, and the second frame F42 includes a scan period SP42 and an emission period EP42.

For a reset period RP41 in the scan period SP41, the power voltage (QVA[1:n]) of the first level VSS1 may be supplied to the power supply lines (QVAi, . . . , QVAn), and the power voltage (QVB[1:n]) of the second level VSS2 may be supplied to the power supply lines (QVBi, QVBn).

For the reset period RP41, the signals (EA[1:n], EB[1:n]) of the disable level (H) are applied to the emission lines (EA1, . . . , EAn and EB1, . . . , EBn), so the sixth and seventh transistors T6 and T7 of all pixels (PXs) are turned off. The power voltages (QVA[1:n]) of the first level VSS1 and the power voltages (QVB[1:n]) of the second level VSS2 are applied to the fourth node N4 and the fifth node N5 of all pixels (PXs), so the voltage level at the respective ends of the first and second light emitting diodes NEDa and NEDb of all pixels (PXs) may be reset with the same level.

For a data programming period DP51, the scan signals (GI[1:n], GW[1:n]) of the enable level (L) are sequentially applied to the scan lines (GI1, . . . , GIn, GW1, . . . , GWn).

Scan signals applied to the first scan line GI1 and the second scan line GW1 connected to the pixel PX in the first row will now be exemplified.

For a period (t0-t1), the first scan signal (GI[1]) of the enable level (L) is applied to the first scan line GI1. The initialization voltage (VINT) is then transmitted to the first node N1 through the fourth transistor T4 of the turned on pixel PX in the first row to reset the same.

For a period (t1-t2), the second scan signal (GW[1]) of the enable level (L) is applied to the second scan line GW1. The data signal from the data lines (D1, . . . , Dm) is sequentially transmitted to the storage capacitor Cst of the pixel PX in the first row.

Within the emission period EP41, the power supply 51 does not supply a power voltage to the power supply lines (QVB1, . . . , QVBn). Therefore, the power supply lines (QVB1, . . . , QVBn) are in the floating state.

The emission control signals (EA[1:n]) of the enable level (L) are simultaneously (e.g., concurrently) applied to the emission control lines (EA1, . . . , EAn). A driving current caused by the voltage difference between the voltage at the gate of the first transistor T1 of all pixels (PXs) and the power voltage (VDD) is then generated, and the driving current is supplied to the first light emitting diode (NEDa) of all pixels (PXs) through the third transistor T3 of all pixels (PXs).

The driving method within the scan period SP42 of the second frame F22 corresponds to the driving method within the scan period SP41 of the first frame, so no description thereof will be provided.

Within the emission period EP42 of the second frame F22, the power supply 51 does not supply a power voltage to the power supply lines (QVA1, . . . , QVAn). Therefore, the power supply lines (QVA1, . . . , QVAn) are in the floating state.

The emission control signals (EB[1:n]) of the enable level (L) are simultaneously (e.g., concurrently) applied to the emission control lines (EB1, . . . , EBn). A driving current caused by the voltage difference between the voltage at the gate of the first transistor T1 of all pixels (PXs) and the power voltage (VDD) is then generated, and the driving current is supplied to the second light emitting diode (NEDb) of all pixels (PXs) through the fourth transistor T4 of all pixels (PXs).

According to the driving method shown with reference to FIG. 9 and FIG. 10, for the period except the emission period, the anodes and the cathodes of the light emitting diodes NEDa and NEDb may be initialized by supplying the power voltages VSS1 and VSS2 to the power supply lines (QVA1, . . . , QVAn, QVB1, . . . , QVBn). Therefore, more accurate grays may be expressed by initializing the charges stored by parasitic capacitance of the light emitting diodes NEDa and NEDb. Further, according to the above-described driving method, the light emitting diodes NEDa and NEDb may be initialized during the scan period.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. A pixel comprising:

a first transistor configured generate a driving current corresponding to a data signal transmitted from a corresponding data line;

a first light emitting diode (LED) including a cathode connected to a first power supply line and an anode connected to a second power supply line, and configured to emit light by the driving current;

a second light emitting diode (LED) including a cathode connected to the second power supply line and an anode connected to the first power supply line, and configured to emit light by the driving current;

a second transistor connected to the anode of the first light emitting diode (LED), and configured to transmit the driving current to the first light emitting diode (LED); and a third transistor connected to the anode of the second light emitting diode (LED), and configured to transmit the driving current to the second light emitting diode (LED), wherein power voltages corresponding to the first power supply line and the second power supply line are applied within a period in which the second transistor and the third transistor are turned off, wherein a first power voltage applied to the first power supply line corresponds to a second power voltage applied to the second power supply line, wherein a first end of the second transistor is connected to a first end of the third transistor at a same node, when the second transistor is turned on, the driving current is transmitted to the anode of the first light emitting diode (LED), and when the third transistor is turned on, the driving current is transmitted to the anode of the second light emitting diode (LED).

2. The pixel of claim 1, further comprising:

a fourth transistor including a first end connected to the data line, a second end connected to a first node, and a gate connected to a corresponding scan line; and a capacitor including a first electrode connected to the first node and a second electrode connected to a third power supply line configured to receive a third power voltage that is different from the first and second power voltages.

3. The pixel of claim 2, wherein the fourth transistor is configured to be turned on for a period in which the second transistor and the third transistor are turned off.

4. The pixel of claim 3, further comprising:

a fourth transistor including a first end connected to the data line, a second end connected to the first end of the first transistor at a first node, and a gate connected to a corresponding first scan line;

a fifth transistor including a first end connected to the second end of the first transistor at a second node, a second end connected to the gate of the first transistor at a third node, and a gate connected to the first scan line;

a capacitor including a first electrode connected to the third node, and a second electrode connected to a third power supply line configured to receive a third power voltage that is different from the first and second power voltages;

a sixth transistor including a first end connected to the third node, a second end connected to an initialization voltage line configured to receive an initialization voltage, and a gate connected to a corresponding second scan line; and a seventh transistor including a first end connected to a third voltage line, a second end connected to the first node, and a gate connected to a corresponding emission control line.

5. The pixel of claim 4, wherein the fourth transistor, the fifth transistor, and the sixth transistor are configured to be turned on for a period in which the second transistor and the third transistor are turned off, and the seventh transistor is configured to be turned on for a period in which one of the second transistor and the third transistor is turned on.

6. A display device comprising:

a scan driver configured to transmit a plurality of scan signals to a plurality of scan lines;

a data driver configured to transmit a plurality of data signals to a plurality of data lines;

a power supply configured to supply a first power voltage, a second power voltage, and a third power voltage to a plurality of first power supply lines, a plurality of second power supply lines, and a third power supply line;

a display unit including a plurality of pixels connected to a corresponding first power supply line from among the plurality of first power supply lines, a corresponding second power supply line from among the plurality of second power supply lines, the third power supply line, a corresponding scan line from among the plurality of scan lines, and a corresponding data line from among the plurality of data lines, and configured to enable the plurality of pixels to emit light according to a corresponding data signal and display an image; and a signal controller configured to control the scan driver, the data driver, and the power supply, wherein the plurality of pixels respectively include:

a first transistor configured to generate a driving current corresponding to the data signal transmitted from the data line;

a first light emitting diode (LED) including a cathode connected to the first power supply line and an anode connected to the second power supply line, and configured to emit light by the driving current;

a second light emitting diode (LED) including a cathode connected to the second power supply line and an anode connected to the first power supply line, and configured to emit light by the driving current;

a second transistor connected to the anode of the first light emitting diode (LED), and configured to transmit the driving current to the first light emitting diode (LED); and a third transistor connected to the anode of the second light emitting diode (LED), and configured to transmit the driving current to the second light emitting diode (LED), wherein the first power voltage and the second power voltage are applied to the first power supply line and the second power supply line within a period in which the second transistor and the third transistor are turned off, wherein the first power voltage is equivalent to the second power voltage, wherein a first end of the second transistor is connected to a first end of the third transistor at a same node, the driving current is transmitted to the anode of the first light emitting diode (LED) when the second transistor is turned on, and the driving current is transmitted to the anode of the second light emitting diode (LED) when the third transistor is turned on.

7. The display device of claim 6, wherein first light emitting diodes (LEDs) of the plurality of pixels are configured to sequentially emit light for one period, and second light emitting diodes (LED) of the plurality of pixels are configured to sequentially emit light for a next period.

8. The display device of claim 6, wherein first light emitting diodes (LEDs) of the plurality of pixels are configured to concurrently emit light for one period, and second light emitting diodes (LED) of the plurality of pixels are configured to concurrently emit light for a next period.

9. The display device of claim 6, wherein the plurality of pixels respectively include:

a fourth transistor including a first end connected to the data line, a second end connected to a first node, and a gate connected to the scan line; and a capacitor including a first electrode connected to the first node, and a second electrode connected to the third power supply line.

10. The display device of claim 9, wherein the fourth transistor is configured to be turned on for a period in which the second transistor and the third transistor are turned off.

11. The display device of claim 6, further comprising:

a light emission driver configured to transmit a plurality of first emission control signals to a plurality of first emission control lines, a plurality of second emission control signal to a plurality of second emission control lines, and a plurality of third emission control signals to a plurality of third emission control lines, wherein the plurality of scan lines include a plurality of first scan lines and a plurality of second scan lines, and the plurality of pixels respectively further include:

a fourth transistor including a first end connected to the data line, a second end connected to a first end of the first transistor at a first node, and a gate connected to a corresponding first scan line from among the plurality of first scan lines;

a fifth transistor including a first end connected to a second end of the first transistor at a second node, a second end connected to a gate of the first transistor at a third node, and a gate connected to the first scan line;

a capacitor including a first electrode connected to the third node, and a second electrode connected to a third power supply line for receiving a third power voltage that is different from the first and second power voltages;

a sixth transistor including a first end connected to the third node, a second end connected to an initialization voltage line for receiving an initialization voltage, and a gate connected to a corresponding second scan line from among the plurality of second scan lines; and a seventh transistor including a first end connected to a third voltage line, a second end connected to the first node, and a gate connected to a corresponding first emission control line from among the plurality of first emission control lines.

12. The display device of claim 11, wherein the fourth transistor, the fifth transistor, and the sixth transistor are configured to be turned on for a period in which the second transistor and the third transistor are turned off, and the sixth transistor is configured to be turned on for a period in which one of the second transistor and the third transistor is turned on.

13. A method for driving a display device, the display device including a plurality of pixels including a first transistor for generating a driving current corresponding to a data signal transmitted from a corresponding data line, a first light emitting diode (LED) including a cathode connected to a first power supply line and an anode connected to a second power supply line, and configured to emit light by the driving current, a second light emitting diode (LED) including a cathode connected to the second power supply line and an anode connected to the first power supply line, and configured to emit light by the driving current, a second transistor connected to the anode of the first light emitting diode (LED), and configured to transmit the driving current to the first light emitting diode (LED), a third transistor connected to the anode of the second light emitting diode (LED), and configured to transmit the driving current to the second light emitting diode (LED), and a fourth transistor turned on by a scan signal transmitted from a corresponding scan line and configured to transmit the data signal, the method comprising:

turning off the second transistor and the third transistor;

applying power voltages corresponding to the first power supply line and the second power supply line;

applying a corresponding power voltage to one of the first power supply line and the second power supply line; and turning on one corresponding to the power supply line to which the corresponding power voltage is applied from among the second transistor and the third transistor.

14. The method of claim 13, wherein the turning off of the second transistor and the third transistor further includes turning on the fourth transistor so as to transmit the data signal.

15. The method of claim 13, wherein a first power voltage applied through the first power supply line is equivalent to a second power voltage applied through the second power supply line.

* * * * *